US011001462B2

(12) United States Patent
Adachi

(10) Patent No.: US 11,001,462 B2
(45) Date of Patent: May 11, 2021

(54) RECORDING-MEDIUM CONTAINER AND IMAGE FORMING APPARATUS

(71) Applicant: FUJI XEROX CO., LTD., Tokyo (JP)

(72) Inventor: Yuichi Adachi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/274,247

(22) Filed: Feb. 13, 2019

(65) Prior Publication Data

US 2020/0031596 A1 Jan. 30, 2020

(30) Foreign Application Priority Data

Jul. 24, 2018 (JP) ..... JP2018-138411

(51) Int. Cl.

| | |
|---|---|
| ***B65H 1/12*** | (2006.01) |
| ***B65H 1/04*** | (2006.01) |
| ***B65H 1/26*** | (2006.01) |
| ***B65H 1/24*** | (2006.01) |

(52) U.S. Cl.

CPC ..... *B65H 1/24* (2013.01); *B65H 1/12* (2013.01); *B65H 1/266* (2013.01); *B65H 2405/11* (2013.01); *B65H 2511/10* (2013.01); *B65H 2511/12* (2013.01)

(58) Field of Classification Search

CPC ..... B65H 1/266; B65H 1/04; B65H 2511/12; B65H 2511/10; B65H 2511/20; B65H 2511/21; B65H 1/12; B65H 1/14

See application file for complete search history.

(56) References Cited

U.S. PATENT DOCUMENTS

| | | | | |
|---|---|---|---|---|
| 2012/0061908 | A1* | 3/2012 | Ueda | B65H 1/266 271/162 |
| 2015/0014921 | A1* | 1/2015 | Abe | B65H 1/12 271/264 |
| 2016/0334747 | A1* | 11/2016 | Wakabayashi | B65H 1/24 |

FOREIGN PATENT DOCUMENTS

| | | | |
|---|---|---|---|
| JP | 2000118730 | A * | 4/2000 |
| JP | 2003089436 | | 3/2003 |
| JP | 2007119175 | A * | 5/2007 |
| JP | 2008303051 | A * | 12/2008 |

* cited by examiner

*Primary Examiner* — Luis A Gonzalez
(74) *Attorney, Agent, or Firm* — JCIPRNET

(57) ABSTRACT

A recording-medium container includes a press portion and an urging member. The press portion is disposed to be movable toward and away from a side of a recording medium stack loaded in the recording-medium container, and pressed against the side. The urging member urges the press portion toward the recording medium stack when a quantity of the recording medium stack exceeds a predetermined load.

9 Claims, 5 Drawing Sheets

RECORDING-MEDIUM CONTAINER AND IMAGE FORMING APPARATUS

CROSS-REFERENCE TO RELATED APPLICATIONS

This application is based on and claims priority under 35 USC 119 from Japanese Patent Application No. 2018-138411 filed Jul. 24, 2018.

BACKGROUND

(i) Technical Field

The present disclosure relates to a recording-medium container and an image forming apparatus.

(ii) Related Art

Japanese Unexamined Patent Application Publication No. 2003-89436 discloses a sheet feed cassette that includes a first elastic member, which raises a bottom plate that receives sheets, and a second elastic member, which complements the urging force of the first elastic member.

SUMMARY

When a press portion, which is to be pressed against a side of a recording medium stack, is urged or moved toward the recording medium stack, the press portion is more easily pressed against the side than otherwise, that is, not being urged or moved. On the other hand, urging or moving the press portion is more likely to deform the recording medium stack with the pressure.

Aspects of non-limiting embodiments of the present disclosure relate to facilitation of pressing of a press portion against a recording medium stack without deforming the recording medium stack unlike in the case of urging or moving the press portion toward the recording medium stack regardless of the quantity of the recording medium stack loaded in the container.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording-medium container that includes a press portion and an urging member. The press portion is movable toward and away from a side of a recording medium stack loaded in the container and is pressed against the side. The urging member urges the press portion toward the recording medium stack when the quantity of the recording medium stack loaded in the container exceeds a predetermined load.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will now be described in detail below with reference to the appended drawings.

Figure 1:
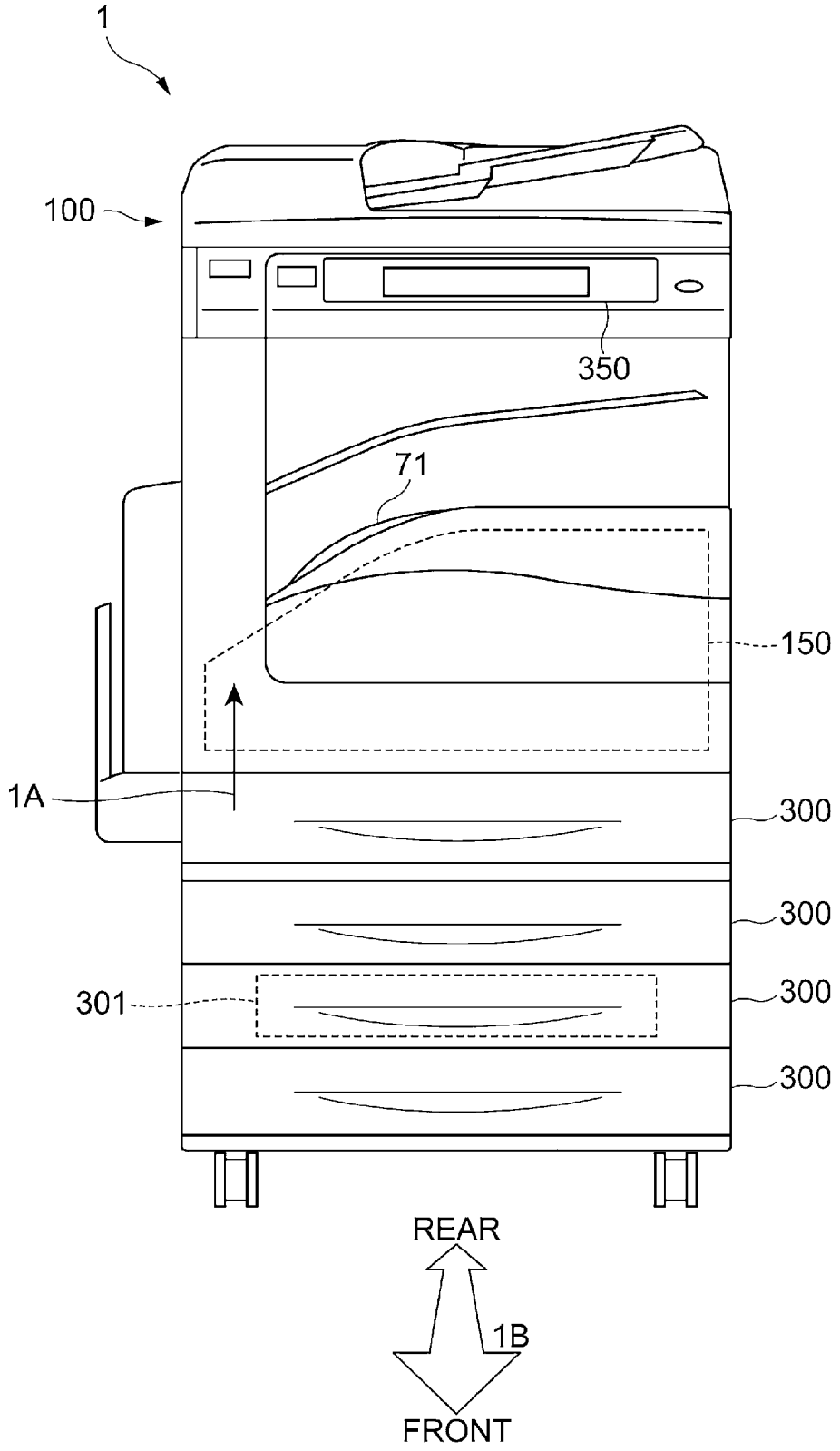
FIG. 1 illustrates an image forming apparatus.

FIG. 1 illustrates an image forming apparatus 1 according to an exemplary embodiment.

The image forming apparatus 1 includes an image reading device 100, which reads an image on a document.

The image forming apparatus 1 also includes an image forming portion 150, which forms images on sheets, which are an example of a recording medium.

The image forming apparatus 1 includes multiple sheet containers 300, which are an example of a recording-medium container. The sheet containers 300 accommodate sheets that are fed to the image forming portion 150.

The image forming apparatus 1 also includes a user interface 350, formed of a touch screen or another device. The user interface 350 receives information input by a user and displays information for a user.

The image forming portion 150, which is an example of an image forming member, forms images on sheets by a so-called electrophotographic system. Instead of an electrophotographic system, the image forming portion 150 may form images by, for example, an inkjet system.

When the image forming portion 150 forms images, sheets are fed from any of the multiple sheet containers 300 to the image forming portion 150, as indicated with arrow 1A.

After the image forming portion 150 forms images on sheets, the sheets having images formed thereon are stacked on a sheet receiving portion 71.

Here, each of the sheet containers 300 includes a pull 301, which is held by a user and drawn out in one direction indicated with arrow 1B for sheet supplementation or other purposes.

In other words, each of the sheet containers 300 is drawn out to the near side in the drawing. More specifically, each of the sheet containers 300 is drawn out to the front of the image forming apparatus 1.

Then, after the sheet supplementation to the sheet container 300, the sheet container 300 is pressed in the direction opposite to the one direction (pressed toward the rear of the image forming apparatus 1) to be returned to the original position.

Figure 2A:
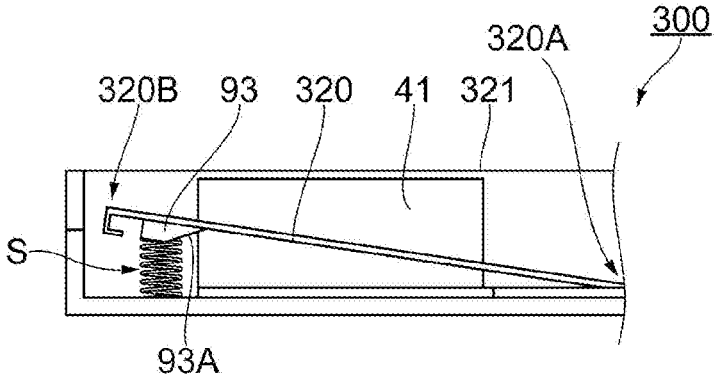
FIGS. 2A and 2B illustrate a sheet container.
Figure 2B:
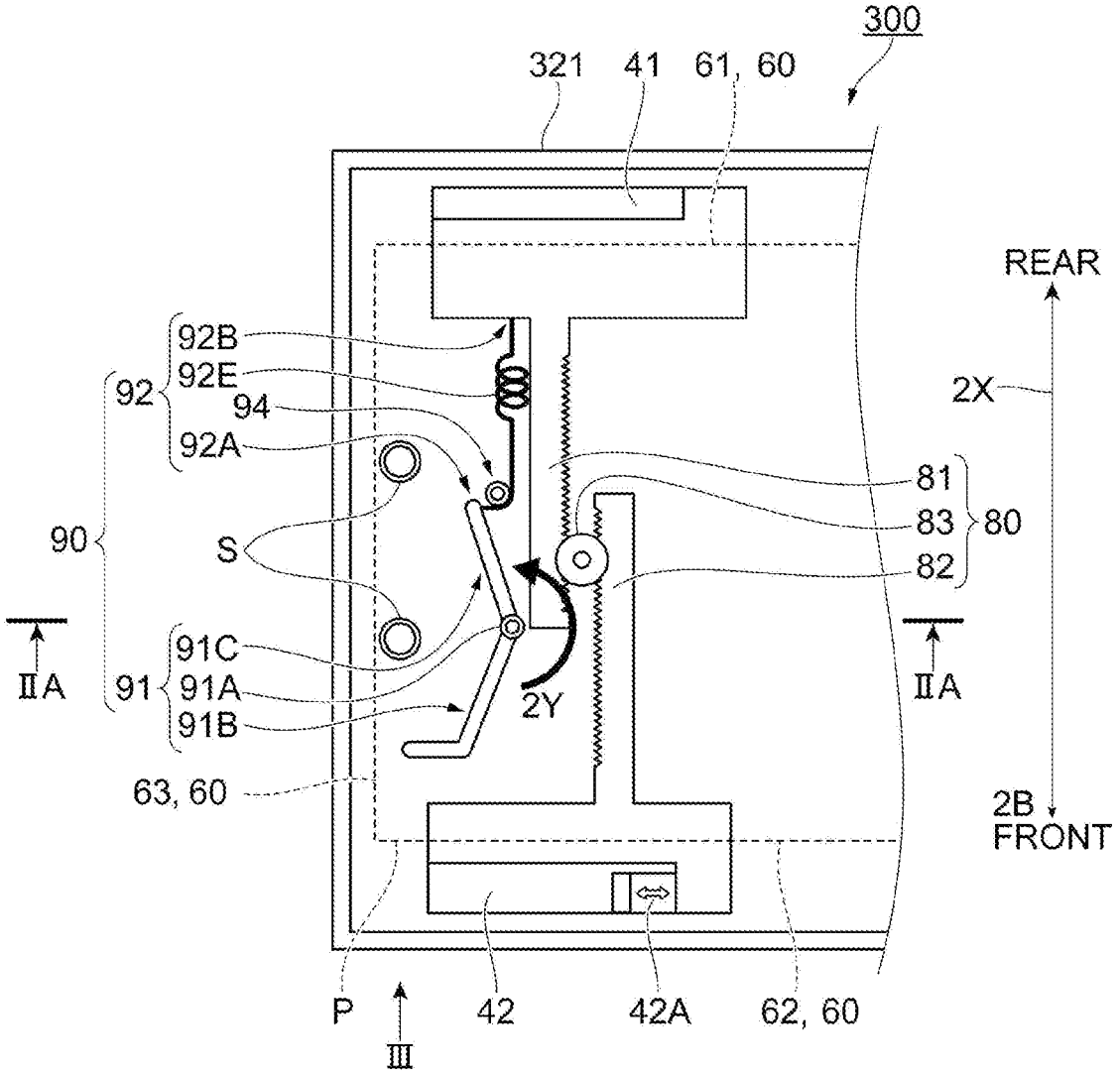

FIGS. 2A and 2B illustrate one of the sheet containers 300.

FIG. 2A illustrates the internal structure of one of the sheet containers 300, viewed from the front.

Specifically, FIG. 2A is a cross-sectional view of one of the sheet containers 300, taken along line IIA-IIA of FIG. 2B. FIG. 2B is a top view of the sheet container 300.

FIG. 2B omits an illustration of a support portion 320 illustrated in FIG. 2A.

As illustrated in FIGS. 2A and 2B, the sheet container 300 includes a box-shaped body 321, which accommodates sheets.

As illustrated in FIG. 2A, the sheet container 300 also includes, inside the body 321, a support portion 320, which supports sheets (not illustrated in FIG. 2A) loaded in the sheet container 300 from below.

The support portion 320 has a first end portion 320A fixed to the bottom of the body 321, and is rotatable about the first end portion 320A. In this exemplary embodiment, in response to rotation of the support portion 320 about the first end portion 320A, a second end portion 320B of the support portion 320 moves up and down.

The sheet container 300 also includes coil springs S, which support the support portion 320 from below. In this exemplary embodiment, the coil springs S contract in accordance with loading of sheets on the support portion 320, so that the support portion 320 lowers.

In this exemplary embodiment, as illustrated in FIG. 2B, the sheet container 300 also includes a first press portion 41 and a second press portion 42, which are pressed against the sides of sheets P loaded in the sheet container 300.

The first press portion 41 and the second press portion 42 are disposed at different positions in the direction of arrow 2X in FIG. 2B.

More specifically, the first press portion 41 and the second press portion 42 are disposed at different positions in the direction in which the sheet containers 300 are drawn out (the direction indicated with arrow 1B in FIG. 1 or the direction indicated with arrow 2B in FIG. 2B).

As shown in FIG. 2B, the second press portion 42 is disposed downstream of the first press portion 41 in the direction in which the sheet containers 300 are drawn out or in a drawn-out direction. In other words, the first press portion 41 is disposed upstream of the second press portion 42 in the drawn-out direction.

In this exemplary embodiment, the second press portion 42 serves as a press portion located most downstream in the drawn-out direction. More specifically, in this exemplary embodiment, the first press portion 41 is located to the rear and the second press portion 42 is located to the front.

The first press portion 41 and the second press portion 42 are movable toward and away from sides 60 of the sheets P loaded on the support portion 320.

The sheets P are rectangular, and each have a first side 61 and a second side 62, opposing each other, and a third side 63 and a fourth side (not illustrated), similarly opposing each other.

The first press portion 41 is movable toward and away from the first side 61 of the sheets P. The second press portion 42 is movable toward and away from the second side 62, opposite to the first side 61.

Although not illustrated, in this exemplary embodiment, the support portion 320 has, for example, cuts or through-holes, and the first press portion 41 and the second press portion 42 are disposed in the cuts or the through-holes.

In this exemplary embodiment, the first press portion 41 and the second press portion 42 are thus prevented from interfering with the support portion 320.

In this exemplary embodiment, a user, who is an operator, operates the first press portion 41 and the second press portion 42 to press the first press portion 41 against the first side 61 of the sheets P or to press the second press portion 42 against the second side 62 of the sheets P.

In this exemplary embodiment, the sheets P are thus fixed in position.

As illustrated in FIG. 2B, this exemplary embodiment includes an interlocking mechanism 80, which interlocks the first press portion 41 and the second press portion 42. In this exemplary embodiment, when a user operates the second press portion 42 to move the second press portion 42, the first press portion 41 moves accordingly.

Specifically, in this exemplary embodiment, the second press portion 42, which is located to the front of the image forming apparatus 1, serves as a press portion that is handled and operated by a user (serves as a user-operable object).

In this exemplary embodiment, when the second press portion 42 is operated by a user to move toward the sheets P, the first press portion 41 also moves toward the sheets P in association with this movement of the second press portion 42.

Conversely, when the second press portion 42 is operated by a user to move away from the sheets P, the first press portion 41 also moves away from the sheets P in association with this movement of the second press portion 42.

The interlocking mechanism 80 includes a first rack 81, which is coupled to the first press portion 41 and extends toward the second press portion 42, and a second rack 82, which is coupled to the second press portion 42 and extends toward the first press portion 41. The interlocking mechanism 80 also includes a gear 83, which is engaged with the first rack 81 and the second rack 82.

In this exemplary embodiment, when the operator moves the second press portion 42, the second rack 82 moves, the gear 83 rotates, and the first rack 81 moves. Thus, the first press portion 41 moves.

The second press portion 42 includes an operation portion 42A, operable by an operator. To move the second press portion 42, the operation portion 42A is operated by the operator.

More specifically, the second press portion 42 is fixed to the bottom surface of the body 321. To move the second press portion 42, the operation portion 42A is operated to release the second press portion 42. Then, the second press portion 42 is moved.

As illustrated in FIG. 2B, each of the sheet containers 300 according to the exemplary embodiment includes an urging mechanism 90, which is an example of an urging member that urges the first press portion 41 toward the sheets P.

The urging mechanism 90 urges the first press portion 41 toward the sheets P when the quantity of the sheets P loaded exceeds a predetermined load. In other words, the urging mechanism 90 may be regarded as a moving device, which moves the first press portion 41 toward the sheets P when the quantity of the sheets P loaded is large and the support portion 320 reaches a position below a predetermined position.

The urging mechanism 90 includes a rotating portion 91, which rotates about a rotation shaft 91A, and a coupling portion 92, which couples the rotating portion 91 and the first press portion 41 with each other.

As illustrated in FIG. 2A, the urging mechanism 90 also includes a pressing portion 93, which is disposed on the undersurface of the support portion 320 to press a part of the rotating portion 91 from above.

The pressing portion 93 has a slope 93A, inclined with respect to the horizontal direction and the vertical direction. The slope 93A is inclined upward toward the first end portion 320A of the support portion 320.

As illustrated in FIG. 2B, the rotating portion 91 includes a rotation shaft 91A, a first projection 91B, which projects outward in the radial directions of the rotating portion 91, and a second projection 91C, which projects outward in the radial directions of the rotating portion 91.

In this exemplary embodiment, the first projection 91B projects in the direction different from the direction in which the second projection 91C projects. The first projection 91B projects frontward of the image forming apparatus 1, whereas the second projection 91C projects rearward of the image forming apparatus 1.

In this exemplary embodiment, the coupling portion 92 is coupled to the far end of the second projection 91C.

The coupling portion 92 includes a first coupling portion 92A, coupled to the rotating portion 91, and a second coupling portion 92B, coupled to the first press portion 41.

This exemplary embodiment also includes a contact portion 94, which contacts the coupling portion 92.

The contact portion 94 contacts a portion of the coupling portion 92 between the first coupling portion 92A and the second coupling portion 92B. The contact portion 94 is formed from a columnar member extending upward from the bottom surface of the body 321. The columnar member is preferably rotatable in the circumferential direction.

In this exemplary embodiment, the support portion 320 lowers with the weight of the sheets P on the support portion 320.

In this exemplary embodiment, when the quantity of the sheets P loaded on the support portion 320 exceeds the predetermined load, and the support portion 320 reaches a position below the predetermined position, the pressing portion 93 presses a part of the rotating portion 91.

Figure 3:
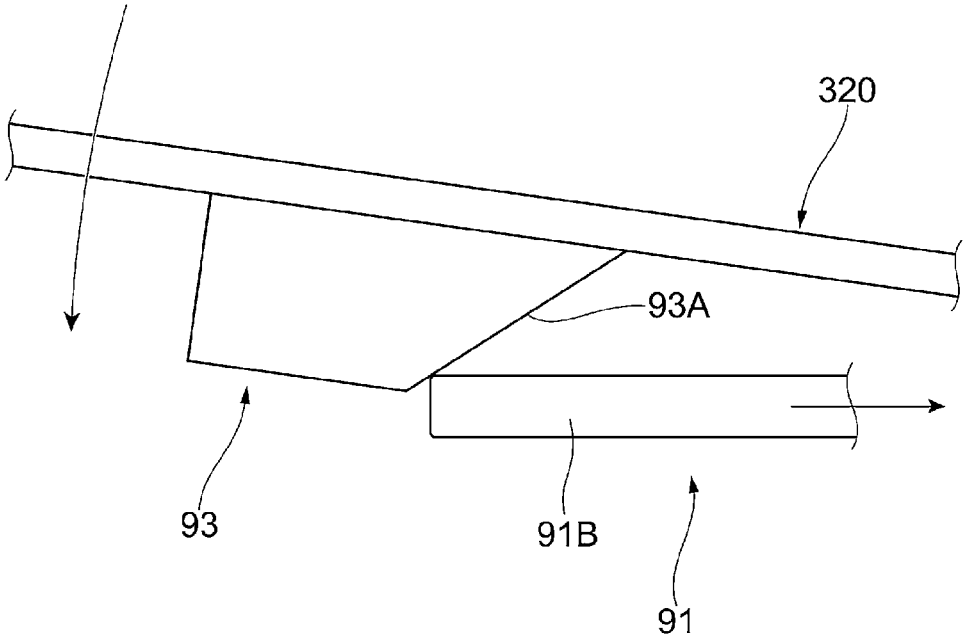
FIG. 3 illustrates a pressing portion and a rotating portion viewed in the direction of arrow III of FIG. 2B, in the state where the pressing portion presses the rotating portion.

FIG. 3 illustrates the pressing portion 93 (refer to FIG. 2A) and the rotating portion 91 viewed in the direction of arrow III of FIG. 2B, in the state where the pressing portion 93 presses the rotating portion 91.

In this exemplary embodiment, when the quantity of the sheets P (not illustrated in FIG. 3) loaded on the support portion 320 exceeds the predetermined load and the support portion 320 lowers a large extent, the pressing portion 93 presses the far end of the first projection 91B of the rotating portion 91, as illustrated in FIG. 3. Specifically, the slope 93A of the pressing portion 93 presses the far end. Thus, the first projection 91B moves rightward in the drawing.

When the first projection 91B moves rightward in the drawing, the rotating portion 91 rotates counterclockwise, as indicated with arrow 2Y in FIG. 2B.

Figure 4:
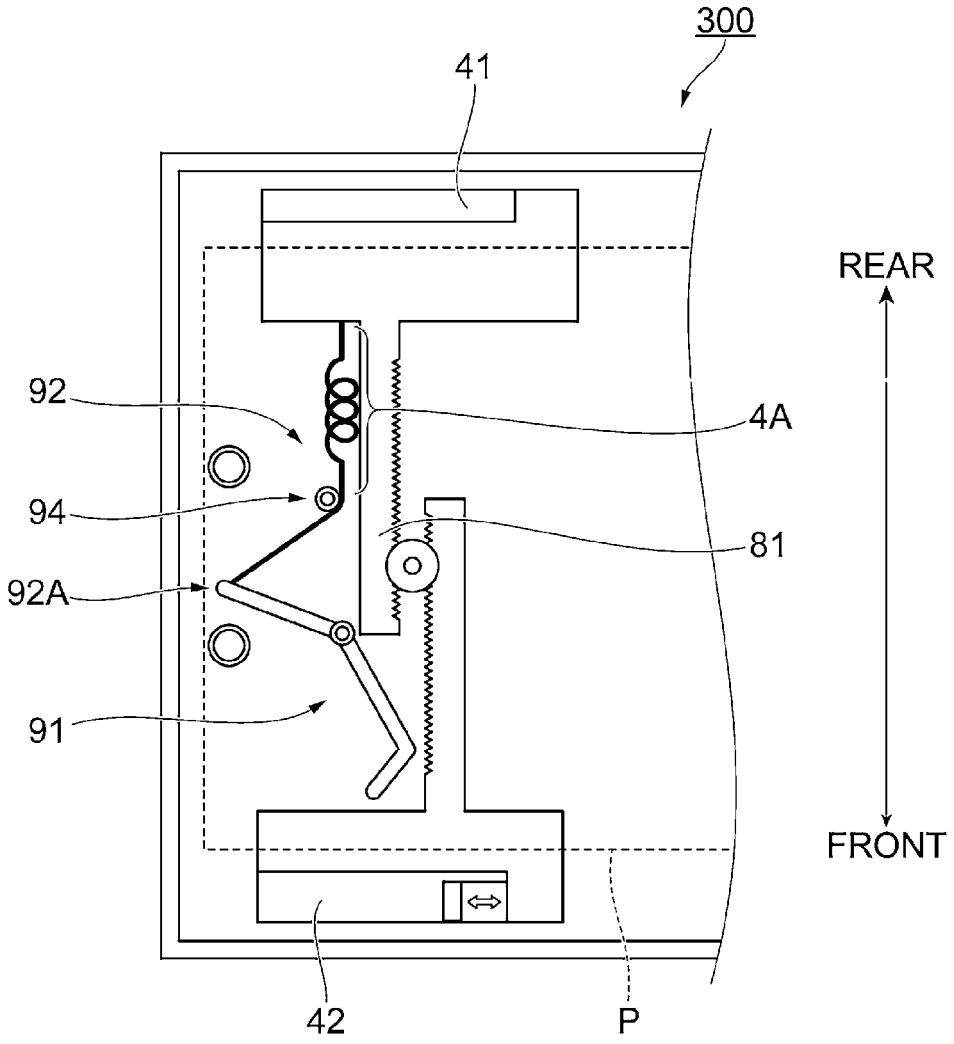
FIG. 4 illustrates the sheet container in the state after the rotating portion rotates.

FIG. 4 illustrates one of the sheet containers 300 in the state after the rotating portion 91 rotates.

When the rotating portion 91 rotates, the first coupling portion 92A of the coupling portion 92 is pulled leftward in the drawing, and accordingly, the first press portion 41 is urged toward the sheets P.

In this exemplary embodiment, the contact portion 94 contacts the coupling portion 92. Thus, the first press portion 41 is pulled downward in FIG. 4. More specifically, the first press portion 41 is pulled in the direction in which the first rack 81 extends.

In this exemplary embodiment, the contact portion 94 allows a portion of the coupling portion 92 located closer to the first press portion 41 than the contact portion 94 (portion denoted with 4A) to extend in the direction in which the first press portion 41 moves (to extend vertically in the drawing).

In this case, the pulling force exerted on the first press portion 41 is larger than that in the case where the portion of the coupling portion 92 located closer to the first press portion 41 than the contact portion 94 is inclined without being aligned with this movement direction. Thus, in this case, the urging force of the first press portion 41 on the sheets P is thus larger.

More specifically, as in the exemplary embodiment, in the case where the coupling portion 92 is pulled using the rotating portion 91, the direction in which the coupling portion 92 extends changes with the rotation of the rotating portion 91.

In this case, the coupling portion 92 may be misaligned with the direction in which the first press portion 41 moves, so that the pulling force exerted on the first press portion 41 may be reduced.

On the other hand, the contact portion 94 in the exemplary embodiment prevents the direction in which the coupling portion 92 extends from being changed with the rotation of the rotating portion 91, so that the coupling portion 92 is aligned with the direction in which the first press portion 41 moves.

In this exemplary embodiment, the first press portion 41 is urged toward the sheets P with the force exerted on the rotating portion 91 from the lowering support portion 320. More specifically, in this exemplary embodiment, the first press portion 41 is urged toward the sheets P using the weight of the sheets P loaded on the support portion 320.

In this exemplary embodiment, the force exerted from above to below in the vertical direction (force exerted from the sheets P to the rotating portion 91 located below) is converted into the force exerted in the horizontal direction to urge the first press portion 41.

Instead of being connected to both the first press portion 41 and the second press portion 42, the urging mechanism 90 according to the exemplary embodiment (refer to FIG. 2B) is connected to the first press portion 41, and the first press portion 41 is urged toward the sheets P. More specifically, in this exemplary embodiment, the urging mechanism 90 is directly connected to only the first press portion 41.

In this exemplary embodiment, when the first press portion 41 is moved toward the sheets P by the urging mechanism 90, the second press portion 42 is moved by the interlocking mechanism 80, and also urged toward the sheets P.

In this exemplary embodiment, the urging mechanism 90 is directly connected to the first press portion 41. However, the urging mechanism 90 may be directly connected to the second press portion 42, instead of the first press portion 41.

More specifically, the urging mechanism 90 may be directly connected to the second press portion 42, which is handled and directly operated by an operator.

In this case, the operation load exerted when an operator operates the second press portion 42 is reduced further than in the case where the urging mechanism 90 is connected to the first press portion 41.

More specifically, in this case, the urging force from the urging mechanism 90 is directly exerted on the second press portion 42. Here, the operation load exerted when an operator operates the second press portion 42 is reduced further than in the case where the urging mechanism 90 is connected to the first press portion 41 and the urging force is exerted on the second press portion 42 via the interlocking mechanism 80.

Alternatively, the urging mechanism 90 may be directly connected to both the first press portion 41 and the second press portion 42, instead of either one of the first press portion 41 and the second press portion 42.

In this exemplary embodiment, as illustrated in FIG. 2B, the coupling portion 92 includes a tension spring 92E. The tension spring 92E has its one end connected to the first press portion 41 and its other end connected to the rotating portion 91, which is a driving source.

In this exemplary embodiment, the rotating portion 91 serves as a driving source that urges the first press portion 41 toward the sheets P. The coupling portion 92 includes the tension spring 92E, connected to both the first press portion 41 and the driving source.

The coupling portion 92 including the tension spring 92E facilitates an operator to operate the first press portion 41, compared to the case where the coupling portion 92 does not include the tension spring 92E. Specifically, an operator is capable of easily moving the first press portion 41 away from the sheets P.

More specifically, an operator is capable of moving the first press portion 41 away from the sheets P more easily than in the case, for example, where the coupling portion 92 is formed of only a wire.

An operator may intend to temporarily move the first press portion 41 away from the sheets P. The tension spring 92E facilitates such a movement.

The coupling portion 92 preferably includes the tension spring 92E, also in the above-described case where the coupling portion 92 is connected to the second press portion 42 or where the coupling portion 92 is connected to both the first press portion 41 and the second press portion 42.

Figure 5B:
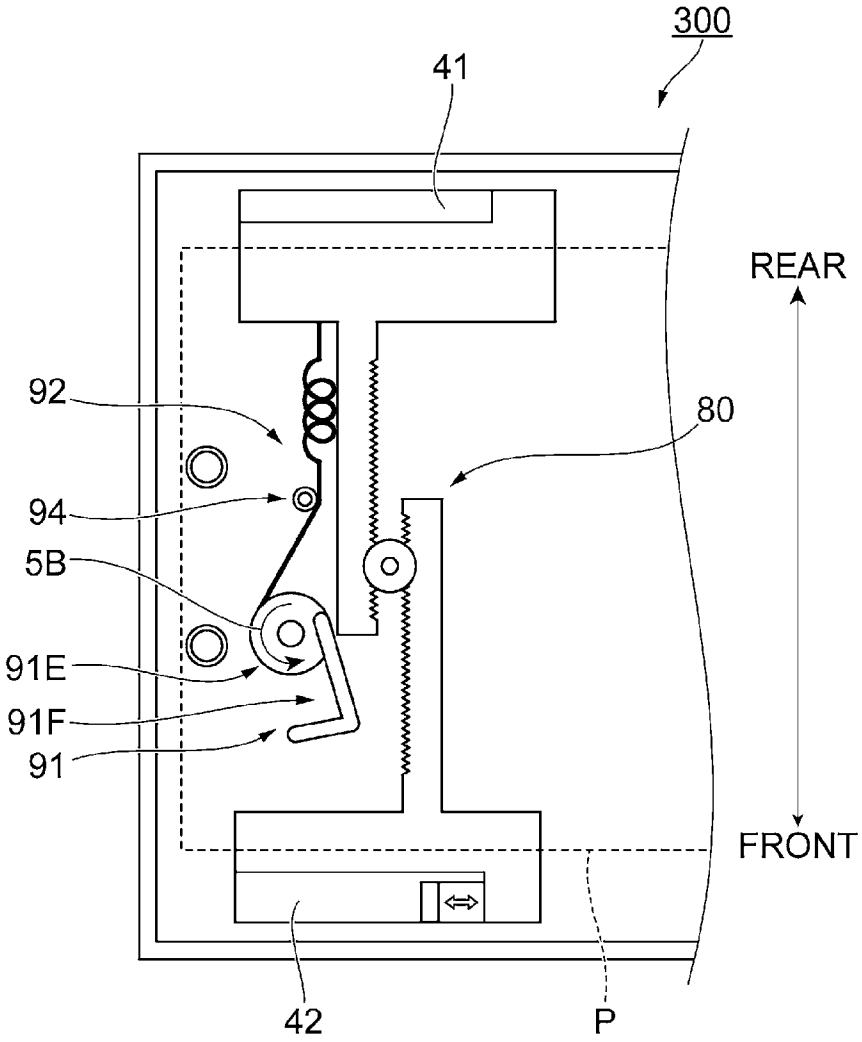
FIGS. 5A and 5B illustrate an example of another structure of the sheet container.
Figure 5A:
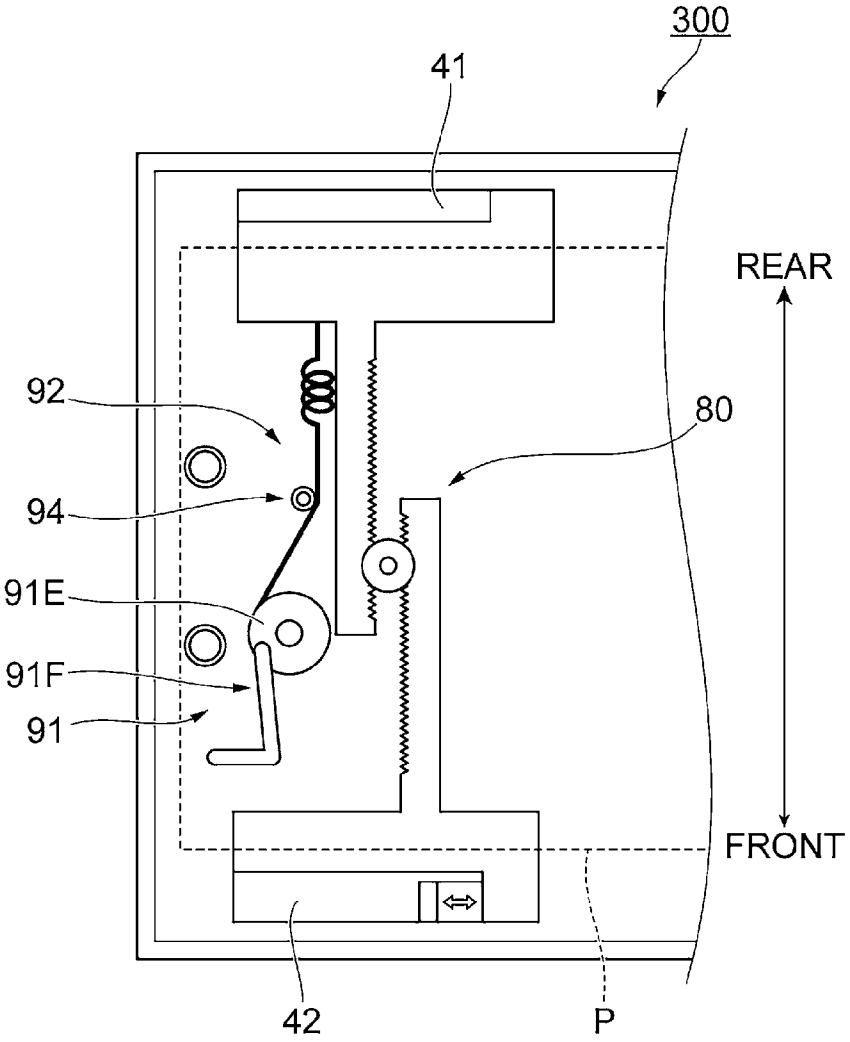

FIGS. 5A and 5B illustrate another structure example of one of the sheet containers 300. FIGS. 5A and 5B are top views of the sheet container 300. Portions having the same functions as above are denoted with the same reference signs and not described herein.

As illustrated in FIG. 5A, this structure example also includes the rotating portion 91.

The rotating portion 91 includes a winding portion 91E, which winds the coupling portion 92 around itself, and a projection portion 91F, which projects outward in the radial directions of the winding portion 91E.

As in the case of the first projection 91B (refer to FIG. 2B), the projection portion 91F projects to the front of the image forming apparatus 1. The projection portion 91F is connected to the winding portion 91E.

Also in this structure example, as in the above case, the pressing portion 93 (not illustrated in FIG. 5, and refer to FIG. 3) presses a part of the rotating portion 91 when the quantity of the sheets P loaded on the support portion 320 exceeds a predetermined load and the support portion 320 reaches a position below a predetermined position.

Specifically, the slope 93A of the pressing portion 93 (refer to FIG. 3) presses the far end of the projection portion 91F of the rotating portion 91.

Thus, in this exemplary embodiment, as illustrated in FIG. 5B, the projection portion 91F moves rightward in the drawing, and accordingly, the winding portion 91E rotates counterclockwise, as indicated with arrow 5B.

When the winding portion 91E rotates, the coupling portion 92 is wound around the winding portion 91E, and thus, the first press portion 41 moves toward the sheets P.

As in the above case, this structure example also includes the interlocking mechanism 80, as illustrated in FIG. 5B. When the first press portion 41 moves toward the sheets P, the second press portion 42 accordingly moves toward the sheets P.

Others

The structure example described above includes the slope 93A disposed to face the pressing portion 93. However, the slope may be disposed to face the rotating portion 91. Alternatively, slopes may be disposed to face both the pressing portion 93 and the rotating portion 91.

Instead of the mechanism including the rotating portion 91, another mechanism may be used as long as it is capable of converting the load exerted downward (load exerted downward from the sheets P) into the load exerted in the horizontal direction.

More specifically, the rotating portion 91 is not indispensable, and a mechanism that does not include the rotating portion 91 may be used to convert the load into the load exerted in the horizontal direction.

In the above description, the first press portion 41 and the second press portion 42 are moved using the weight of the sheets P. Alternatively, the first press portion 41 and the second press portion 42 may be moved using a driving force of a driving source, such as a motor, separately disposed.

In the case where a driving source is separately disposed, for example, a sensor that detects the support portion 320 when it is located below a predetermined position is disposed. When the sensor detects the support portion 320 located below a predetermined position, the driving source is driven.

As in the above structure, also in this case, the first press portion 41 and the second press portion 42 are moved toward the sheets P when the quantity of the sheets P loaded exceeds a predetermined load.

Alternatively, a structure may include an urging portion, such as a spring that urges the first press portion 41 and the second press portion 42 toward the sheets P, and a restricting portion that restricts movement of the first press portion 41 and the second press portion 42 toward the sheets P.

In this structure, for example, the restricting portion is moved using, for example, a force exerted from the support portion 320 when, for example, the support portion 320 is located below a predetermined position. Alternatively, the restricting portion is moved using a force from a driving source such as a motor.

Thus, the restriction of the restricting portion on the movement is released, and the first press portion 41 and the second press portion 42 are urged toward the sheets P.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording-medium container, comprising:

a support portion that supports from below a recording medium stack loaded in the recording-medium container, and that lowers with loading of the recording medium stack;

a press portion disposed to be movable toward and away from a side of the recording medium stack loaded on the support portion, and pressed against the side;

an urging member that urges the press portion toward the recording medium stack when a quantity of the recording medium stack exceeds a predetermined load; and a moving device that moves the press portion toward the recording medium stack when the support portion reaches a position below a predetermined position, wherein the support portion lowers with the weight of the recording medium stack on the support portion, wherein the urging member includes a rotating portion disposed below the support portion and a coupling portion that couples the rotating portion and the press portion with each other, wherein, when the quantity of the recording medium stack loaded in the recording-medium container exceeds the predetermined load, the support portion presses a part of the rotating portion from above and rotates the rotating portion, and, rotation of the rotating portion urges the press portion toward the recording medium stack, and wherein the coupling portion is wound around the rotating portion that rotates, and the press portion is urged toward the recording medium stack.

2. The recording-medium container according to claim 1, wherein the urging member urges the press portion toward the recording medium stack using a weight of the recording medium stack.

3. The recording-medium container according to claim 2, further comprising:

a support portion that supports from below the recording medium stack loaded in the recording-medium container, wherein the support portion lowers with the weight of the recording medium stack on the support portion, and wherein the urging member urges the press portion toward the recording medium stack using a force from the support portion that lowers.

4. The recording-medium container according to claim 1, wherein the press portion comprises a plurality of press portions, and wherein the urging member is connected to at least one of the plurality of press portions, and urges the at least one press portion toward the recording medium stack.

5. The recording-medium container according to claim 4, wherein, when the at least one of the plurality of press portions is urged by the urging member to move toward the recording medium stack, another one of the plurality of press portions moves toward the recording medium stack in association with the at least one of the plurality of press portions.

6. The recording-medium container according to claim 4, wherein the at least one of the plurality of press portions is a press portion handled and operated by an operator.

7. The recording-medium container according to claim 4, wherein the recording-medium container is drawn out in a predetermined direction, wherein the plurality of press portions are disposed at different positions in the predetermined direction, and wherein the at least one of the plurality of press portions is a press portion located most downstream in the predetermined direction among the plurality of press portions.

8. The recording-medium container according to claim 1, wherein the urging member includes a driving source that urges the press portion toward the recording medium stack, and a coupling portion that couples the driving source and the press portion with each other, and wherein the coupling portion includes a tension spring that has one end connected to the press portion and another end connected to the driving source.

9. An image forming apparatus, comprising:

an image forming member that forms an image on a recording medium in a recording medium stack; and a recording-medium container that accommodates the recording medium stack, wherein the recording-medium container is the recording-medium container according to claim 1.

* * * * *